US006540019B2

(12) United States Patent
Willauer

(10) Patent No.: US 6,540,019 B2
(45) Date of Patent: Apr. 1, 2003

(54) INTELLIGENT THRU TUBING BRIDGE PLUG WITH DOWNHOLE INSTRUMENTATION

(75) Inventor: Darrin L. Willauer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/838,614

(22) Filed: Apr. 19, 2001

(65) Prior Publication Data

US 2002/0020525 A1 Feb. 21, 2002

Related U.S. Application Data

(60) Provisional application No. 60/198,605, filed on Apr. 19, 2000.

(51) Int. Cl.[7] ..... E21B 49/08

(52) U.S. Cl. ..... 166/119; 166/184; 166/188; 166/192; 340/853.2; 340/853.3; 367/81; 364/528.17

(58) Field of Search ..... 166/119, 131, 166/133, 135, 141, 183, 184, 185, 188, 192; 340/853.2, 853.3; 364/528.17, 528.36; 367/81

(56) References Cited

U.S. PATENT DOCUMENTS

| | | | | |
|---|---|---|---|---|
| 5,027,894 | A | * | 7/1991 | Coone et al. |
| 5,417,122 | A | | 5/1995 | Casey et al. |
| 5,868,201 | A | | 2/1999 | Bussear et al. |

FOREIGN PATENT DOCUMENTS

| | | | |
|---|---|---|---|
| GB | 2349657 | | 11/2000 |
| GB | 0109632 | * | 9/2001 |

* cited by examiner

*Primary Examiner*—Roger Schoeppel
(74) *Attorney, Agent, or Firm*—Cantor Colburn LLP

(57) ABSTRACT

A conventional thru tubing bridge plug is rendered in a more effective and useful downhole tool by incorporating a sensor module complete with preferably a plurality of downhole sensors to monitor downhole parameters such as but not limited to temperature and pressure both within the inflatable tool and in the annulus of the well created thereby.

17 Claims, 6 Drawing Sheets

INTELLIGENT THRU TUBING BRIDGE PLUG WITH DOWNHOLE INSTRUMENTATION

CROSS REFERENCE TO RELATED APPLICATIONS

Figure 1:
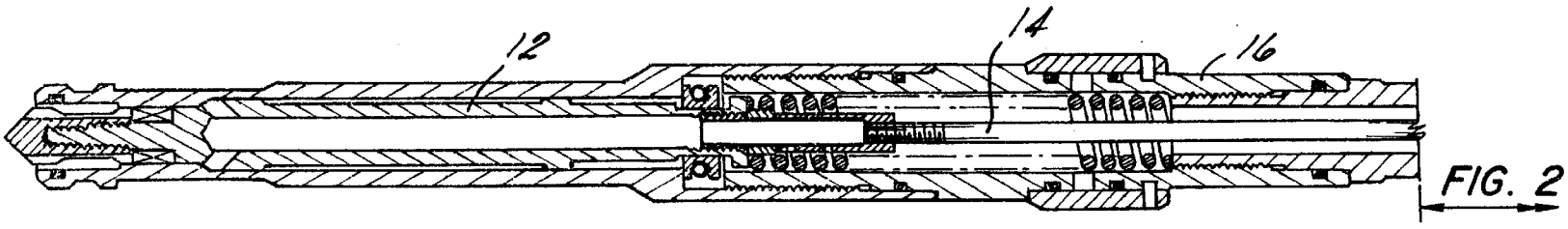

This application claims the benefit of an earlier filing date from U.S. Provisional Application Ser. No. 60/198,605, filed Apr. 19, 2000 which is fully incorporated herein by reference.

BACKGROUND

Thru tubing retrievable bridge plugs provide a means of temporarily plugging selected sections of a well, without the need for pulling production tubing. Avoidance of the need to pull the production tubing dramatically reduces costs associated with plugging particular sections of a well. Different sections of a well might need to be plugged because of, for example, water breakthrough, gas production, etc. Retrievable bridge plugs are also run to plug certain sections of a well in order to test different fluids flowing into the well at that location or above that location from shallower zones within the wellbore. Such bridge plugs generally include a lower valve which provides a seal, blanking off a section of mandrel so that a packer element, also contained within the retrievable bridge plug, can be inflated. The packing element provides for the plugging off of the selected sections of the well. The construction and use of a conventional bridge plug is considered known to one of ordinary skill in the art. Such bridge plugs are commercially available from many sources including Baker Oil Tools, Houston, Tex. (Product Nos. 340-10 and 330-72).

SUMMARY

The above-identified drawbacks of the prior art are overcome, or alleviated, by the intelligent bridge plug system of the invention.

The present invention avails itself of the benefits evident in conventional retrievable bridge plugs and further provides a method and apparatus for accurately setting the inflation pressure of a retrievable bridge plug and verification of that setting. The apparatus of the invention is a thru tubing bridge plug having downhole instrumentation and employing an electric wireline setting tool such as that disclosed in co-pending U.S. Ser. No. 60/123,306, filed Mar. 5, 1999, the entire contents of which is incorporated herein by reference. The device further comprises several sections of a retrievable bridge plug and several downhole sensors. The sensors are worked into the tool preferably in a sensor module which is a part of the retrievable bridge plug assembly. The sensor module is located in different sections of the tool for different embodiments as disclosed hereinbelow. The tool of the invention preferably measures element inflation pressure, temperature inside the packer and the annulus temperature as well as pressure uphole of (above) and downhole of (below) the packer. These parameters of the well may be used to ensure a proper setting of the inflatable element and thereby ensure that the bridge plug operates as intended. The invention provides a superior advantage over the prior art for many reasons including that the temperature of the inflation fluid is nearly always cooler than the temperature downhole. If a packer is fully inflated with relatively cooler fluid, the thermal expansion of that fluid subsequent to filling could rupture the element. Such occurrence could be problematic and would preferably be avoided. The present invention provides the means to avoid such a condition and also will provide a high degree of confidence that the inflatable element is properly inflated every time the bridge plug is employed.

It is also important to note that one of the key points in measuring pressure below the bridge plug is to determine how the well is responding to the plug. This is an important benefit of the invention not heretofore available; comparing pressure above the plug with pressure below the plug which provides information about whether or not a zone has been effectively shut off and whether or not the packer has achieved a good seal. The existence of leaking through the casing or through fractures in the formation, etc. would be identified by comparing the above and below pressure. Moreover, the comparison indicated above provides information about whether or not pressure below a plug is being adversely affected by other wells in a situation where production wells and injection wells are operating in the same field. Furthermore, by monitoring all three of above the plug pressure, below the plug pressure and element inflation pressure verification can be obtained that the inflation pressure ratings for the element being employed have not been exceeded.

IN THE DRAWINGS

FIGS. 1–5 are an elongated view of a cross-section with a first embodiment of the invention; and FIGS. 6–10 are an elongated view of a cross-section of a second embodiment of the invention.

DETAILED DESCRIPTION

Figure 2:
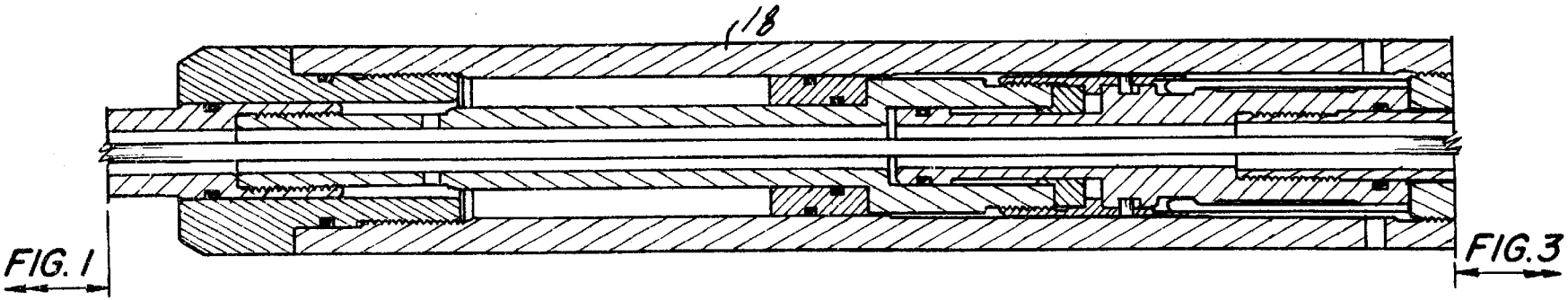

Referring to FIGS. 1–5, a first embodiment of the invention is illustrated. It will be appreciated by one of ordinary skill in the art that FIGS. 1 and 2 and FIGS. 4 and 5 depict portions of the inventive bridge plug that are identical to a prior art bridge plug commercially available from Baker Oil Tools, Houston, Tex., under Product Nos. 340-10 and 330-72. Since these portions are very well known to the art, a detailed description thereof is not necessary to a full understanding of the invention. For orientation and clarity, one of skill in the art will recognize upper valve sleeve 12, valve shaft 14 and equalizing mandrel 16 in FIG. 1. In FIG. 2, bumper housing 18 and associated components will be recognized.

Figure 3:
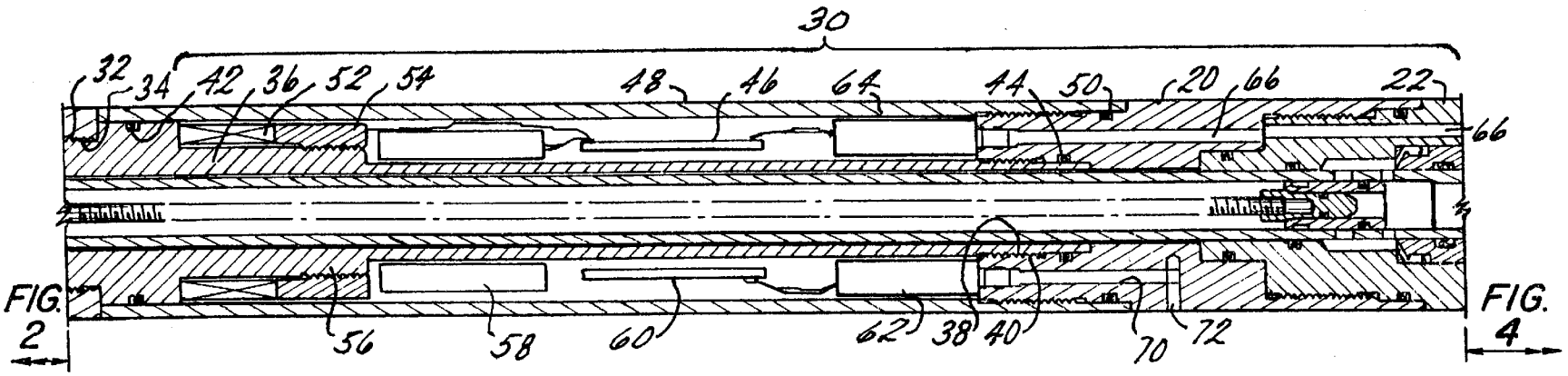
Figure 4:
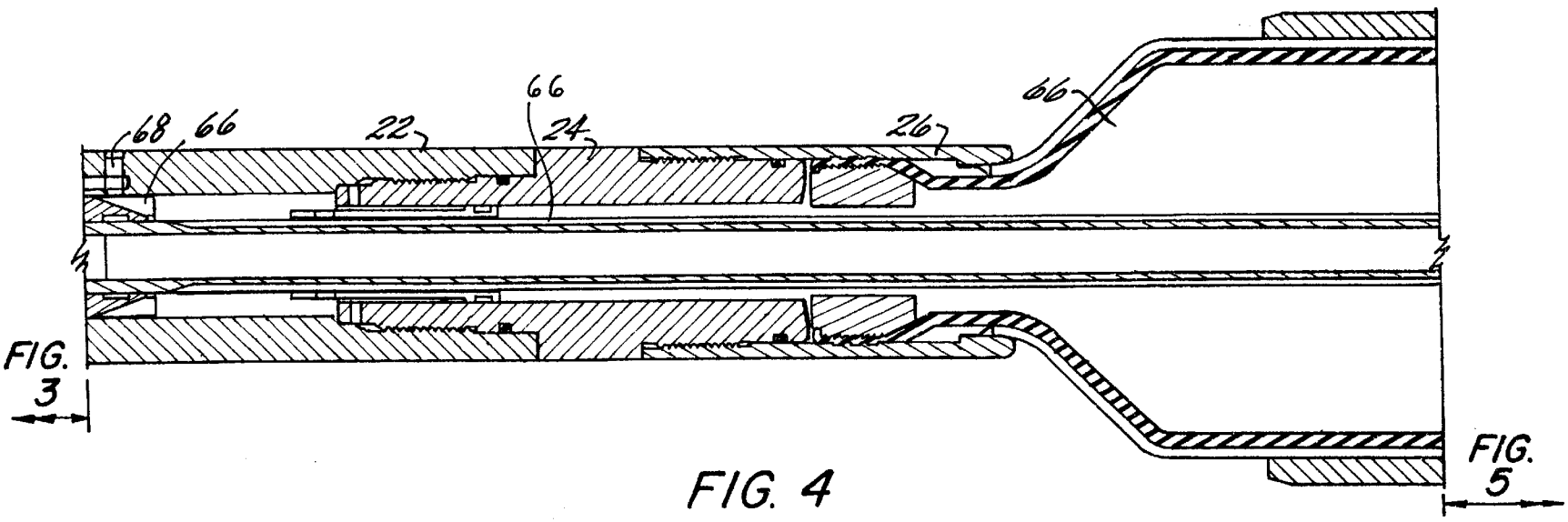
Figures 4, 5:
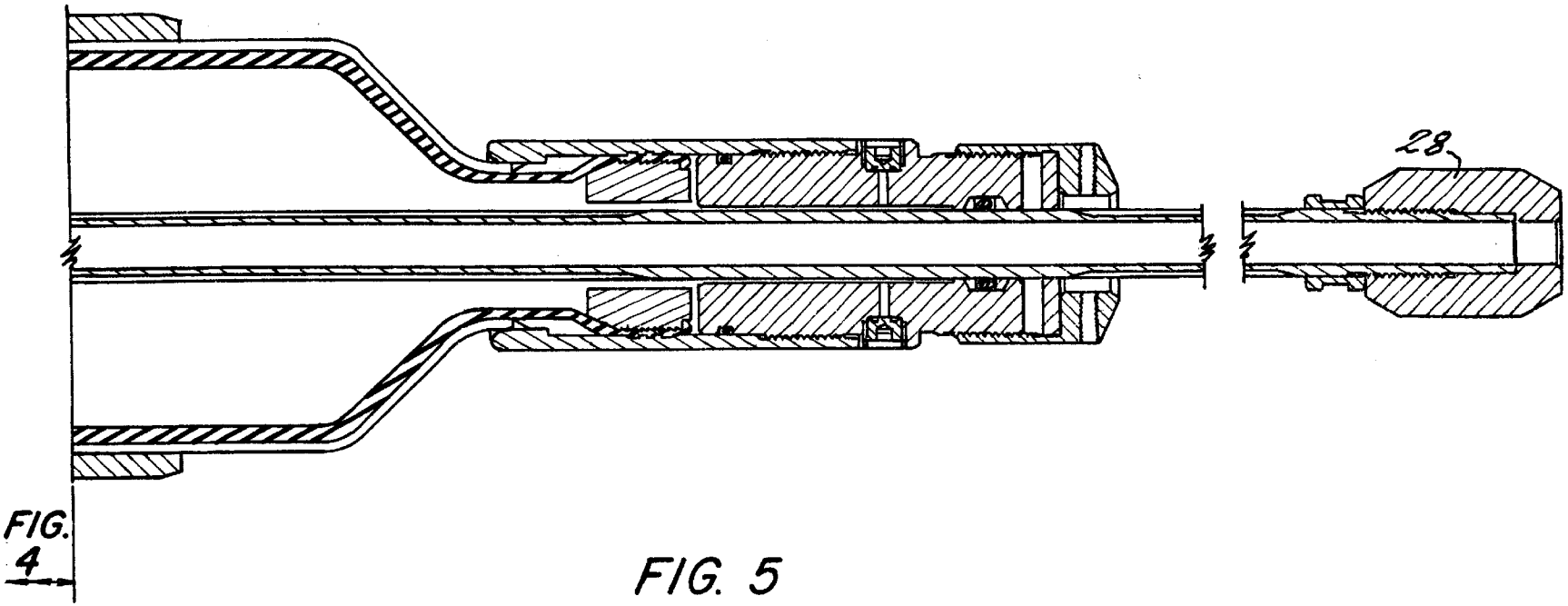
Figure 6:
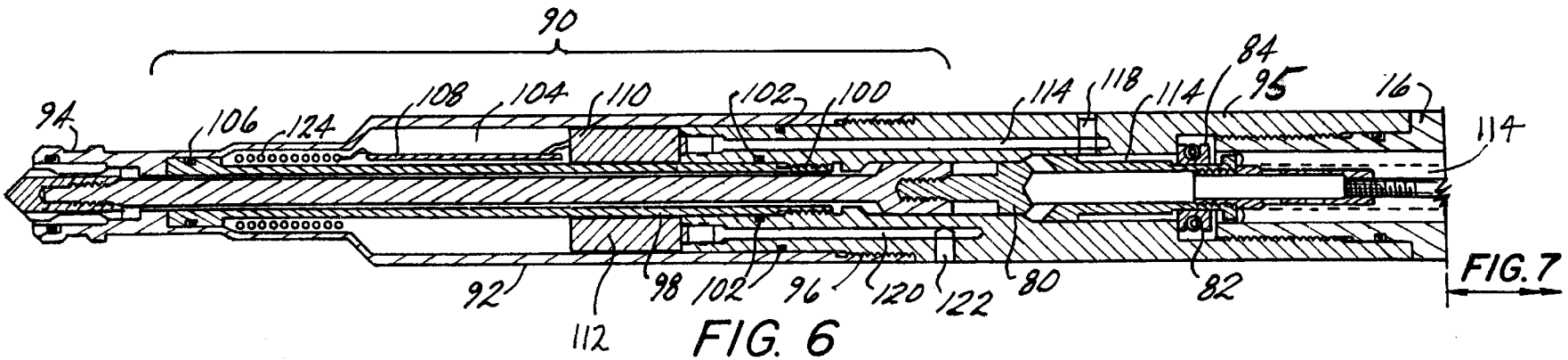
Figure 7:
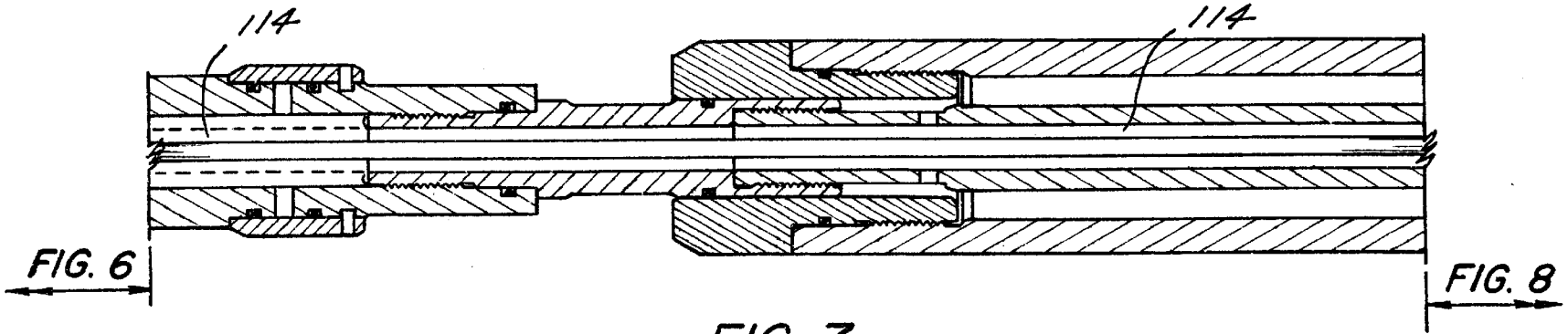
Figure 8:
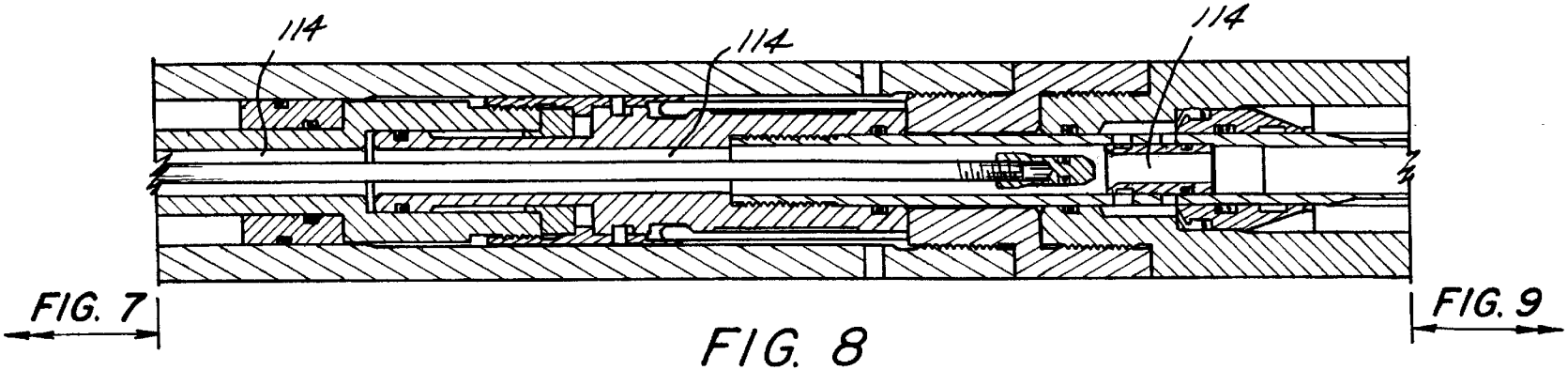
Figure 9:
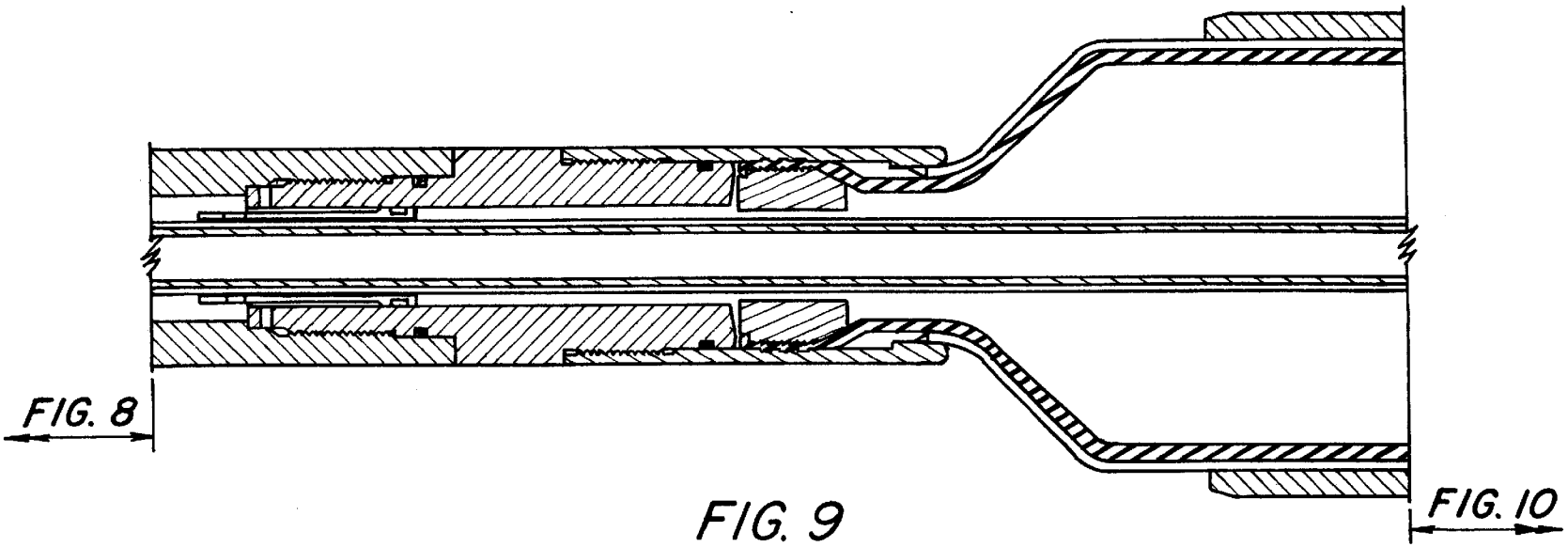
Figures 9, 10:
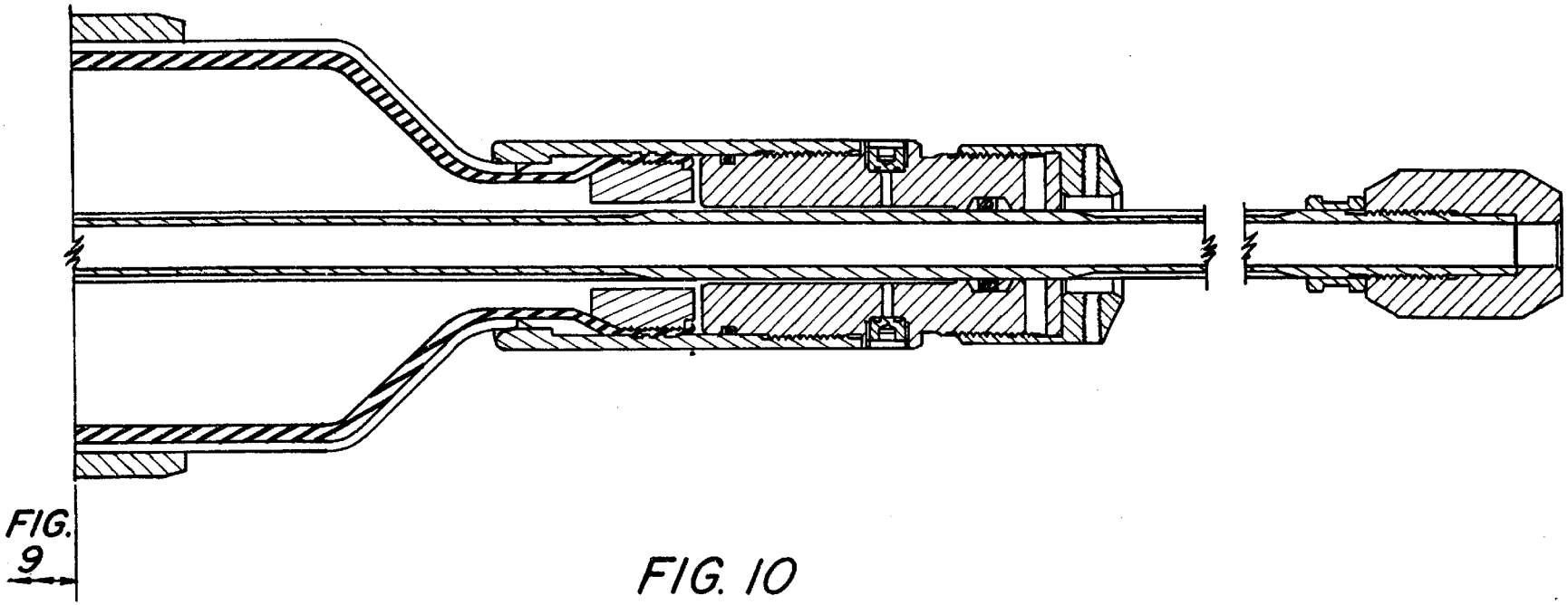

Referring now to FIG. 3, the sensor module 30 of the invention is illustrated. Sensor module 30 is important to the function desired in the present invention since it houses all of power, telemetry and sensor assemblies. Module 30 is essentially "cut into" the conventional tool in the position, in this embodiment, illustrated by FIGS. 1–5. Where bumper housing 18 would be connected to collet sub 20 in a prior art tool, the sensor module 30 is connected therebetween. It is important to note that collet sub 20 is modified in the invention to provide pressure paths which allow the sensing desired in the invention to take place. Poppet housing 22 is also modified, again to provide a pressure path for the sensing desired in the invention. Pressure is measured at the back side of the poppet to obtain accurate element pressure. The balance of the tool in this embodiment, referring to FIGS. 4 and 5 is conventional. One of skill in the art will recognize spring housing 24 connected to poppet housing 22 and element 26 connected to spring housing 24. Guide 28 is shown at the downhole end of the tool at the right side of FIG. 5.

Referring back to FIG. 3, the detail of the invention is discussed. At the box thread 32 of bumper housing 18, an uphole end of sensor module 30 is provided with a pin thread 34. The pin thread 34 is actually cut on a mandrel 36 of sensor module 30. Mandrel 36 is connected at its downhole end at pin thread 38 to collet sub 20 via box thread 40. Mandrel 36 is made pressure tight between tubing pressure and exterior wellbore pressure by o-rings 42 and 44 on the uphole and downhole ends thereof, respectively. Since sensitive electronic equipment must be delivered to the downhole environment in this tool, it is necessary to create a sealed chamber which may be atmospheric or hydraulic fluid filled. The chamber is numeraled 46 and is formed annularly between mandrel 36 and sleeve housing 48. Sleeve housing 48 shares an o-ring with mandrel 36 at 42 and is provided with an additional o-ring 50 at an outer surface of collect sub 20. Chamber 46 is filled, in the invention, with a transmitter 52 locked in a desired position as shown by locking ring 54 which is threadedly connected to mandrel 36 at thread 56. Transmitter 52, preferably a piezo ceramic transducer, is connected via contacts (not shown) to an electrical control module with signal receiver 60 which is connected to battery pack 58. The control module regulates power to the transmitter 52, receiver 60 and the pressure transducers. Typically, a sine or square wave is sent to the transmitter to create either pulser or frequency acoustic outputs. It should be noted that several different control modules 60 or a single annular one may be employed. It is preferable to employ several modules 60 to reduce cost of manufacture. Constructing annular circuit boards for modules is expensive. The one or more modules 60 are connected to pressure transducers 62 and 64 which each monitor pressure in a different place via pressure pathways as shown. Pressure transducer 64 is "plumbed" to element pressure via pathway 66. Numeral 66 is repeated several times in the drawings to indicate the pathway. It will be noted that plug 68 is provided to close annular pressure from conduit 66. The plug is needed as a consequence of the manufacturing process for creating the pressure pathway 66 to element pressure.

In the case of pressure transducer 62, a pressure pathway 70 is provided which is left open to annulus pressure at port 72. This transducer will sense annulus pressure above the element 26 (FIG. 5). Differences between this pressure location and pressure below the element provides information about the setting of the element 26. Pressure below the annulus is measured by a similar set of components which cannot be seen in this drawing but will be understood to one of skill in the art by exposure to the shown component sets illustrated.

The tool as described is operable in several modes. One mode is a continuous data stream mode wherein the transmitter of the invention transmits acoustic (radio wave, electromagnetic wave, vibration or other) data at all times. As required or desired, a receiver is run in the hole to acquire the acoustic (radio wave, electromagnetic wave, vibration or other) signal and transmit data uphole. It should be noted that in situations where it is physically possible for the signal from the transmitter to reach the surface on its own, a receiver can be positioned at the surface. In another mode of operation of the invention, data is stored downhole until a signal to transmit is received by the tool. The signal could be generated at the surface and sent downhole or generated downhole by a receiver run in the hole for that purpose and for retrieving the data released.

In another embodiment of the invention, referring to FIGS. 6–10, a sensor module is differently configured and is located in a position within the otherwise conventional (except for pressure pathways) bridge plug. Power and communication is provided through an inductive coupler coil discussed hereunder. In this embodiment, it is the uphole end of the tool which is most modified from its conventional cousin. For clarity, conventional components such as upper valve sleeve 80, lock segments 82, extension spring 84 and equalizing mandrel 16 are numbered. All other downhole components of the tool are conventional except for pressure pathways as noted in each of the figures. Pressure pathways are numbered in numerous places on the figures to provide an understanding to one of ordinary skill in the art as to the precise location thereof.

Focusing on the sensor module 90 in this embodiment of the invention, a sensor housing 92 has an uphole profile 94 to act as a fishing neck which functions as is known in the art. It will be appreciated that in prior art bridge plugs the fishing neck would be threaded directly to the equalizing mandrel 16. In the invention however, the equalizing mandrel 16 is threadedly connected to a porting sub 95 threadedly connected to sensor housing 92 at thread 96 and inner mandrel 98 at thread 100. The connections to porting sub 95, as stated, are sealed with o-rings 102.

A chamber 104 is created between inner mandrel 98 and sensor housing 92 which is sealed at the uphole end by o-ring 106 against an i.d. of sensor housing 92. Within chamber 104, electronic equipment similar to the first discussed embodiment is disposed. At least one electronic control module(s) 108 is connected to pressure transducers 110 and 112. Pressure transducer 110 is connected to pressure pathway 114 which leads to annulus pressure downhole of the element 26. Plug 118 is required incident to the manufacturing process to prevent annulus pressure above the element 26 from being registered. Conversely, pressure transducer 112 measures pressure in the annulus uphole of element 26 through pressure pathway 120 which has access to annulus pressure through port 122.

In this embodiment, power is provided to the electronic components enumerated above via an inductive coupler coil 124. Power will thus be initiated at the surface or another remote power source. Since batteries are not the limiting factor on the life of this tool regarding testing of the parameters readable by the electronics therein, readings may be performed at any time, even many years after installation of the tool simply by providing power via a complementary coil (not shown). The sensors so powered can then communicate with a remote location or store data for later retrieval through the inductive coupler which in such an embodiment is employed as a communication link to a remote location. In one embodiment, the inductive coupler will not supply power at all but rather will act solely as a communications pathway and will function to extract data from the bridge plug whether the data is stored or is being actively recorded.

In yet another embodiment of the invention, transmission of data is forsaken entirely. More specifically, a battery pack is utilized to power the tool and data is stored on the control module. This activity would continue as long as the battery pack supplies energy. Further the data storage could be continuous or could be at time intervals. Subsequently, when the bridge plug is pulled out of the well, the stored data on the control module could be downloaded for review and/or analysis. It will be appreciated that other sensors for parameters such as gamma radiation, temperature flow and other element or formation parameter may be added to any embodiment hereof.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A downhole parameter sensing retrievable bridge plug comprising:

an inflatable element;

a sensor module connected to said inflatable element; and a pressure transducer calibrated to sense one of annulus pressure uphole of the element and annulus pressure downhole of the element.

2. A downhole parameter sensing retrievable bridge plug as claimed in claim 1 wherein said pressure transducer is a plurality of pressure transducers, each calibrated to sense one of element pressure, annulus pressure uphole of the element, annulus pressure downhole of the element.

3. A downhole parameter sensing retrievable bridge plug as claimed in claim 1 wherein said pressure transducer is connected to a pressure pathway provided in said retrievable bridge plug terminating at an access point to a target pressure.

4. A downhole parameter sensing retrievable bridge plug as claimed in claim 1 wherein said pressure transducer is in pressure reading communication with direct element pressure in said element.

5. A downhole parameter sensing retrievable bridge plug as claimed in claim 1 wherein said bridge plug further comprises a controller module operably connected to said sensor module.

6. A downhole parameter sensing retrievable bridge plug as claimed in claim 5 wherein said control module stores data received from said pressure transducer.

7. A downhole parameter sensing retrievable bridge plug as claimed in claim 1 wherein said sensor module further includes a transmitter operably connected to said pressure transducer, said transmitter having transmission capability.

8. A downhole parameter sensing retrievable bridge plug as claimed in claim 7 wherein said transmitter transmits acoustically.

9. A downhole parameter sensing retrievable bridge plug as claimed in claim 8 wherein said transmitter transmits by radio transmission.

10. A downhole parameter sensing retrievable bridge plug as claimed in claim 9 wherein said transmitter transmits by electromagnetic transmission.

11. A downhole parameter sensing retrievable bridge plug as claimed in claim 5 wherein said control module continuously releases said stored data to a transmitter connected thereto.

12. A downhole parameter sensing retrievable bridge plug as claimed in claim 5 wherein said control module upon command releases said stored data to a transmitter connected thereto.

13. A downhole parameter sensing retrievable bridge plug as claimed in claim 5 wherein said control module at intervals of time releases said stored data to a transmitter connected thereto.

14. A downhole parameter sensing bridge plug comprising:

an inflatable element;

a sensor sensing at least one of annulus pressure uphole of the element and annulus pressure downhole of the element; and a transmitter capable of transmitting information from said sensor to a remote location.

15. A downhole parameter sensing bridge plug as claimed in claim 14 wherein said plug further comprises additional sensors for at least one of the element and the formation.

16. A downhole parameter sensing bridge plug as claimed in claim 15 wherein said sensors sense at least one of temperature, flow rate, pressure, gamma radiation, radio waves, electromagnetic waves or a combination with at least one of the foregoing.

17. A downhole parameter sensing bridge plug comprising:

an inflatable element;

a sensor sensing at least one parameter of the element; and a transmitter capable of transmitting information from said sensor to a remote location, said transmitter transmitting one of acoustically, by radio wave, by electromagnetic wave, and by vibration.

* * * * *